US011204617B2

(12) United States Patent
Okamoto et al.

(10) Patent No.: US 11,204,617 B2
(45) Date of Patent: Dec. 21, 2021

(54) BOAT AND THROTTLE OPERATING DEVICE

(71) Applicant: YAMAHA HATSUDOKI KABUSHIKI KAISHA, Iwata (JP)

(72) Inventors: Yukitaka Okamoto, Shizuoka (JP); Chihiro Matsumoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 58 days.

(21) Appl. No.: 16/274,296

(22) Filed: Feb. 13, 2019

(65) Prior Publication Data

US 2019/0286183 A1 Sep. 19, 2019

(30) Foreign Application Priority Data

Mar. 16, 2018 (JP) ..... JP2018-049499

(51) Int. Cl.
*G05G 1/04* (2006.01)
*B63H 21/21* (2006.01)
*B63B 34/10* (2020.01)

(52) U.S. Cl.
CPC ..... *G05G 1/04* (2013.01); *B63H 21/213* (2013.01); *B63B 34/10* (2020.02)

(58) Field of Classification Search
None
See application file for complete search history.

(56) References Cited

U.S. PATENT DOCUMENTS 6,065,448 A * 5/2000 Hatton ..... F02D 11/10 123/396
2001/0051474 A1* 12/2001 Matsuda ..... B63B 34/10 440/1
2003/0089291 A1* 5/2003 Kanno ..... B63H 21/22 114/144 A
2003/0171044 A1 9/2003 Matsuda et al.
2008/0299847 A1 12/2008 Kaji
2011/0162478 A1 7/2011 Suzuki
2015/0040866 A1 2/2015 Kinoshita
2019/0286183 A1* 9/2019 Okamoto ..... B63H 21/213

FOREIGN PATENT DOCUMENTS

JP 2011-208551 A 10/2011
JP 5543224 B2 7/2014

* cited by examiner

*Primary Examiner* — Vicky A Johnson
(74) *Attorney, Agent, or Firm* — Keating and Bennett, LLP

(57) ABSTRACT

A small boat includes an output that outputs to an engine controller an output signal having an output value at which a throttle opening degree increases as an operation amount of a throttle operator increases, and outputs to the engine controller the output signal having, as an upper limit, a limit output value at which the throttle opening degree is smaller than that at a maximum output value at which the throttle opening degree is maximum.

19 Claims, 6 Drawing Sheets

BOAT AND THROTTLE OPERATING DEVICE

CROSS REFERENCE TO RELATED APPLICATIONS

This application claims the benefit of priority to Japanese Patent Application No. 2018-049499 filed on Mar. 16, 2018. The entire contents of this application are hereby incorporated herein by reference.

BACKGROUND OF THE INVENTION

1. Field of the Invention

The present invention relates to a boat and a throttle operating device.

2. Description of the Related Art

A throttle operating device including a throttle operator is known in general. Such a throttle operating device is disclosed in Japanese Patent No. 5543224, for example.

Japanese Patent No. 5543224 discloses a lever-type throttle operating device (hereinafter referred to as a "throttle operating device") including a throttle lever. The throttle operating device includes an angle sensor that detects the rotational operation angle of the throttle lever and a board that acquires a detection signal from the angle sensor and outputs an output signal. The board outputs the output signal to an engine control unit (hereinafter referred to as an "ECU") via a wiring cord. The ECU controls driving of an engine based on the acquired output signal (detection signal).

Depending on an area (country) in which a small boat including a throttle operating device as disclosed in Japanese Patent No. 5543224 is operated, horsepower regulations or output regulations may be implemented by varying the upper limit of the horsepower based on the license acquired by a boat operator who operates the small boat and the age of the boat operator. In order to cope with such a case, the upper limit of the output value of the output signal output from the throttle operating device may be conceivably limited by mechanically limiting the movable range of the throttle lever. For example, the throttle lever may conceivably include a stopper that mechanically limits the movable range of the throttle lever. However, in this case, an error may conceivably be caused in the limited upper limit of the output value of the output signal output from the throttle operating device due to an error in the mounting position of the stopper or an error in the shape (size) of the stopper (an error due to the structure that mechanically limits the movable range). Therefore, a small boat and a throttle operating device in which the horsepower is more accurately limited have been desired.

SUMMARY OF THE INVENTION

Preferred embodiments of the present invention provide boats and throttle operating devices in which the horsepower is more accurately limited.

A boat according to a preferred embodiment of the present invention includes a throttle operator through which a throttle opening degree of an engine is controlled, an engine controller that controls the throttle opening degree, and an output that outputs to the engine controller an output signal having an output value at which the throttle opening degree increases as an operation amount of the throttle operator increases, and outputs to the engine controller the output signal having, as an upper limit, a limit output value at which the throttle opening degree is smaller than that at a maximum output value at which the throttle opening degree is maximum.

In a boat according to a preferred embodiment of the present invention, the output outputs to the engine controller the output signal having, as an upper limit, the limit output value at which the throttle opening degree is smaller than that at the maximum output value at which the throttle opening degree is maximum. Accordingly, the horsepower of the boat (engine) is limited to an amount corresponding to the limit output value without limiting the upper limit of the operation amount of the throttle operator (without mechanically limiting the movable range). Consequently, unlike the case in which the movable range of the throttle operator is mechanically limited, no error is caused due to the structure that limits the movable range, and thus the upper limit of the output signal is more accurately limited. That is, the horsepower is more accurately limited as compared with the case in which the movable range of the throttle operator is mechanically limited. In addition, even when the maximum horsepower (the amount of horsepower to be a specification value) of the engine mounted on the boat is larger than the horsepower corresponding to the limit output value (the amount of horsepower limited by laws and regulations, for example), the horsepower of the engine of the boat is limited to an amount corresponding to the limit output value. Thus, it is not necessary to prepare the engine that sets the horsepower corresponding to the limit output value to the maximum horsepower separately from the engine having the maximum horsepower larger than the horsepower corresponding to the limit output value, and thus an increase in the number of engine types for the boat is significantly reduced or prevented.

Consequently, the boat complies with horsepower regulations while an increase in the number of engine types is significantly reduce or prevented. In addition, when the horsepower is limited by the engine controller (ECU), it is necessary to prepare a plurality of types of control programs for the engine controller. In this case, it is necessary to design the control program of the engine controller for each limited horsepower, and when the control program is changed, an inspection to operate the engine controller is required for each boat. Thus, the number of inspection steps is increased. On the other hand, according to preferred embodiments of the present invention, the output outputs the output signal having the limit output value as an upper limit to the engine controller such that the horsepower of the boat is limited by changing (replacing) the output (throttle operating device, for example) without changing the control program of the engine controller. Thus, the boat complies with horsepower regulations while the number of inspection steps of the engine controller that operates the entire boat is reduced as compared with the case in which the control program of the engine controller (ECU) is changed.

In a boat according to a preferred embodiment of the present invention, the output preferably outputs the output signal having the limit output value to the engine controller when the operation amount is a maximum operation amount. Accordingly, even when the throttle operator is operated to the maximum operation amount (when the operation amount of the throttle operator is not limited), the output signal having the limit output value as an upper limit is output, and thus the boat complies with horsepower regulations without changing the range (movable range) of the operation amount of the throttle operator.

In such a case, the output preferably outputs the output signal having the limit output value to the engine controller when the operation amount is equal to or larger than an operation amount threshold smaller than the maximum operation amount. Accordingly, output of the output signal that exceeds the limit output value is prevented even when the throttle operator is operated to the operation amount equal to or larger than the predetermined operation amount threshold.

In a boat in which the output signal having the limit output value is output when the operation amount is the maximum operation amount, the output preferably outputs to the engine controller the output signal having the output value at which the throttle opening degree increases as the operation amount increases over a range from the operation amount of 0 to the maximum operation amount. Accordingly, the output value corresponding to the operation amount is output (the throttle opening degree is adjusted) over the range from the operation amount of 0 to the maximum operation amount while the upper limit of the output value is limited to the limit output value, and thus while the boat complies with horsepower regulations, the output value is more precisely adjusted as compared with the case in which the output signal having the limit output value (constant value) at the operation amount equal to or larger than the operation amount threshold is output.

In such a case, the output preferably outputs to the engine controller the output signal having the output value at which the throttle opening degree increases as the operation amount increases such that the operation amount and the output value have a linear or substantially linear function relationship over the range from the operation amount of 0 to the maximum operation amount. Accordingly, even when the upper limit of the output value is limited to the limit output value, a boat operator more intuitively adjusts the output value as compared with the case in which the operation amount and the output value have a relatively complicated relationship (output characteristics) other than the linear function.

In a boat in which the output signal having the limit output value is output when the operation amount is the maximum operation amount, the throttle operator is preferably rotationally operated, the boat preferably further includes an angle detector that detects a rotation angle of the throttle operator, and the output preferably outputs the output signal having the limit output value, when the operation amount is the maximum operation amount, to the engine controller when the rotation angle detected by the angle detector is a maximum angle. Accordingly, the upper limit of the output value of the output signal is limited to the limit output value without limiting the rotation angle of the throttle operator to an angle smaller than the maximum angle (without changing the movable range).

In such a case, the throttle operator preferably extends from a rotation shaft disposed adjacent to a grip grasped by a boat operator in a radial direction of the rotation shaft, and preferably includes a lever that rotates about the rotation shaft toward the grip, the angle detector preferably faces the rotation shaft in the radial direction, and detects a rotation angle of the rotation shaft as the operation amount, and the output preferably outputs the output signal having the limit output value, when that the operation amount is the maximum operation amount, to the engine controller when the rotation angle detected by the angle detector is the maximum angle. A boat may conceivably include an angle detector spaced apart from a rotation shaft of a lever and that detects the rotation angle of the rotation shaft via a mechanical wire provided on the rotation shaft. However, in such a boat, due to the mechanical wire, the number of components increases, and the load required to rotate the lever increases. On the other hand, according to preferred embodiments of the present invention, the angle detector faces the rotation shaft in the radial direction and detects the rotation angle of the rotation shaft as the operation amount such that the rotation angle is detected without providing a mechanical wire, and the output signal corresponding to the rotation angle is output to the engine controller. Consequently, a mechanical wire is not provided, and thus an increase in the number of components in the boat is significantly reduced or prevented while an increase in the load required to rotate the lever is significantly reduced or prevented.

In a boat according to a preferred embodiment of the present invention, the output preferably outputs the output signal having the output value corresponding to the operation amount to the engine controller based on output limitation characteristics information in which the output value including the limit output value as an upper limit and the operation amount are associated with each other. Accordingly, the output easily generates the output signal having the output value corresponding to the operation amount and including the limit output value as an upper limit, referring to the output limitation characteristics information, and outputs the output signal to the engine controller.

In such a case, in the output limitation characteristics information, the operation amount and an output voltage value as the output value are preferably associated with each other, and the output preferably outputs the output signal having a limit output voltage value, which is the output voltage value corresponding to the limit output value, as an upper limit to the engine controller. Accordingly, the output outputs the voltage value corresponding to the operation amount, referring to the output limitation characteristics information, and thus the output easily outputs the output signal having the output value including the limit output value as an upper limit.

A boat in which the output signal is output based on the output limitation characteristics information preferably further includes a setter that sets one of the output limitation characteristics information and output non-limitation characteristics information in which the output value including the maximum output value as an upper limit and the operation amount are associated with each other, and the output preferably outputs the output signal having the output value corresponding to the operation amount to the engine controller based on one of the output limitation characteristics information and the output non-limitation characteristics information set by the setter. Accordingly, setting of the output limitation characteristics information and the output non-limitation characteristics information is switched such that output signals having different output values as upper limits are output from the output using the same type of engine (boat). Consequently, the upper limit of the output value of the output signal is changed according to the limited horsepower (horsepower regulations) using the same type of engine (boat), and thus even when the boat operator is changed (to a boat operator with a different license) or even when the boat is moved to countries having different horsepower regulations, the boat complies with the horsepower regulations.

In such a case, the setter preferably includes a setting operator that receives an operation of setting one of the output limitation characteristics information and the output non-limitation characteristics information. Accordingly, the boat operator or a setting worker operates the setting operator to easily set (select) one of the output limitation characteristics information and the output non-limitation characteristics information.

When the boat includes the setter, the output preferably includes a storage that stores the output limitation characteristics information and the output non-limitation characteristics information. Accordingly, the output limitation characteristics information and the output non-limitation characteristics information are stored in the storage of the output, and thus the output signal is generated using the output limitation characteristics information and the output non-limitation characteristics information stored in the storage without providing the output limitation characteristics information and the output non-limitation characteristics information separately from the output (boat).

In a boat in which the output signal having the limit output value is output when the operation amount is the maximum operation amount, the output preferably includes a maximum signal output that outputs a maximum signal, which is a signal having the maximum output value, when the operation amount is the maximum operation amount, and an output limiter that outputs the output signal in a state in which the maximum output value of the maximum signal output from the maximum signal output is reduced to the limit output value when the operation amount is the maximum operation amount, or outputs the output signal in a state in which the maximum output value of the maximum signal output from the maximum signal output is limited to the limit output value when the operation amount is equal to or larger than an operation amount threshold smaller than the maximum operation amount. Accordingly, the output limiter is added to the structure of the existing output such that the output easily outputs the output signal having the limit output value as an upper limit.

A boat according to a preferred embodiment of the present invention preferably further includes a throttle operating device main body in which the throttle operator and the output are disposed and that is replaceable from a boat body. Accordingly, a throttle operating device main body to which the output signal having the maximum output value as an upper limit is output from the output is replaced with the throttle operating device main body to which the output signal having the limit output value as an upper limit is output from the output such that a state in which the upper limit of the output value of the output signal output from the output becomes the maximum output value is easily changed to a state in which the upper limit of the output value of the output signal output from the output becomes the limit output value using the same type of engine.

In such a case, on the throttle operating device main body, it is preferably visually distinguishable that an upper limit of the output value of the output signal is limited to the limit output value. Accordingly, even when the same type of engine is used, the boat operator recognizes whether or not the upper limit of the output value of the output signal output from the output is limited to the limit output value by visually recognizing the throttle operating device main body.

In a boat in which it is visually distinguishable that the upper limit of the output value is limited to the limit output value on the throttle operating device main body, it is preferably distinguishable by color that the upper limit of the output value of the output signal is limited to the limit output value. Accordingly, the color of the throttle operating device main body in which the upper limit of the output value of the output signal output from the output is limited to the limit output value is different from the color of a throttle operating device main body in which the upper limit of the output value is not limited to the limit output value such that the boat operator more intuitively recognizes whether or not the upper limit of the output value of the output signal is limited to the limit output value.

In a boat according to a preferred embodiment of the present invention, the output preferably outputs an abnormality detection output value as the output signal to the engine controller when the operation amount is 0, and outputs the output signal having the limit output value, which is larger than the abnormality detection output value, as an upper limit to the engine controller when the operation amount is larger than 0, and the engine controller preferably stops driving of the engine or sets the engine to idle when acquiring the output signal having the output value less than the abnormality detection output value. Accordingly, the boat includes an abnormality detection function of stopping the engine or setting the engine to idle when acquiring the output signal having the output value less than the abnormality detection output value, and the output signal having the limit output value as an upper limit is output to the engine controller.

A throttle operating device according to a preferred embodiment of the present invention includes a throttle operator through which a throttle opening degree of an engine is controlled, and an output that outputs to an engine controller that controls the throttle opening degree an output signal having an output value at which the throttle opening degree increases as an operation amount of the throttle operator increases, and outputs to the engine controller the output signal having, as an upper limit, a limit output value at which the throttle opening degree is smaller than that at a maximum output value at which the throttle opening degree is maximum.

In a throttle operating device according to a preferred embodiment of the present invention as described above, the horsepower is more accurately limited.

In a throttle operating device according to a preferred embodiment of the present invention, the output preferably outputs the output signal having the limit output value to the engine controller when the operation amount is a maximum operation amount. Accordingly, even when the throttle operator is operated to the maximum operation amount (when the operation amount of the throttle operator is not limited), a boat including the throttle operating device complies with horsepower regulations without changing the range (movable range) of the operation amount of the throttle operator.

In such a case, the output preferably outputs the output signal having the limit output value to the engine controller when the operation amount is equal to or larger than an operation amount threshold smaller than the maximum operation amount. Accordingly, output of the output signal that exceeds the limit output value is prevented even when the throttle operator is operated to the operation amount equal to or larger than the predetermined operation amount threshold.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a small boat 100 according to a first preferred embodiment of the present invention is now described with reference to FIGS. 1 to 6. The small boat 100 is a personal watercraft (PWC), for example, and is a water jet propelled boat (water motorcycle). That is, the small boat 100 is a straddled watercraft.

Figure 1:
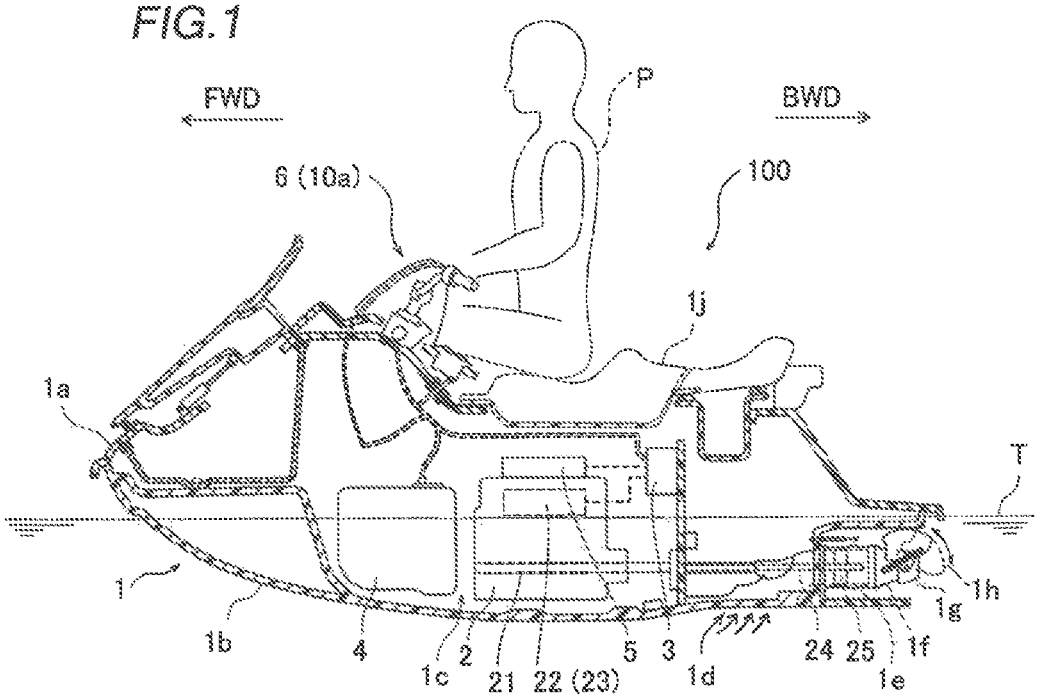
FIG. 1 is a side sectional view showing the overall structure of a small boat according to a first preferred embodiment of the present invention.

As shown in FIG. 1, the small boat 100 includes a boat body 1, an engine 2, an engine controller 3, a fuel tank 4, a fuel injection system 5 (hereinafter referred to as an "FI system 5"), and a handle unit 6 including a forward throttle operating unit 10*a* (hereinafter referred to as a "forward operating unit 10*a*"). The forward throttle operating unit 10*a* is an example of a "throttle operating device" or a "throttle operating device main body".

The boat body 1 includes a deck 1*a* and a hull 1*b*. The boat body 1 is immersed up to a predetermined height (a water surface T in FIG. 1) in a stationary state. An engine room 1*c* that houses the engine 2 driven when the boat body 1 is propelled, the engine controller 3, the fuel tank 4, and the FI system 5 are provided in the boat body 1.

The engine 2 obtains a drive force to rotate a crankshaft 21 by burning an air-fuel mixture in a combustion chamber. Specifically, the engine 2 includes a throttle valve 22 and a throttle valve actuator 23. The opening degree (throttle opening degree) of the throttle valve 22 is changed by the throttle valve actuator 23 such that the amount of air supplied to the combustion chamber of the engine 2 is adjusted. As the opening degree of the throttle valve 22 increases, the rotational speed of the engine 2 increases, and the horsepower of the engine 2 increases. The FI system 5 includes a fuel injection system that supplies fuel at the predetermined timing and an ignition system that ignites an air-fuel mixture at the predetermined timing. The throttle valve actuator 23 and the FI system 5 are electrically connected to the engine controller 3, and are controlled based on commands from the engine controller 3.

The crankshaft 21 is connected to an impeller shaft 24 via a coupling (not shown). The impeller shaft 24 extends rearward from the engine room 1*c*. An impeller 25 is attached in the vicinity of a rear end of the impeller shaft 24. The impeller 25 is disposed inside an impeller housing 1*e* connected to a rear portion of a water intake 1*d*, suctions water below the water surface T from the water intake 1*d*, and jets the water rearward from a nozzle 1*f* provided behind the impeller housing 1*e*.

The boat body 1 includes a deflector 1*g* and a bucket 1*h*. The deflector 1*g* is located behind the nozzle 1*f*, and changes the direction of the water jetted rearward from the nozzle 1*f* to a right-left direction. The handle unit 6 is operated such that the orientation of the deflector 1*g* is changed via a steering cable (not shown) connected to a steering shaft 62 (see FIG. 3) of the handle unit 6 described below. That is, when a pair of grips 12 described below are operated by a rider P, the orientation of the deflector 1*g* is changed, and the small boat 100 is steered.

The bucket 1*h* is moved between the upper side and the rear side of the deflector 1*g* by a bucket actuator 1*i*. When the bucket 1*h* is moved to the rear side of the deflector 1*g*, the bucket 1*h* changes the direction of water jetted rearward from the nozzle 1*f* and the deflector 1*g* to a forward direction. The driving of the bucket actuator 1*i* is controlled by the engine controller 3, as shown in FIG. 2.

As shown in FIG. 1, a seat 1*j* on which the rider P is seated and the handle unit 6 operated to steer the boat body 1 are provided on a portion of the deck 1*a* above the engine 2 in the boat body 1. The handle unit 6 is disposed in front of the seat 1*j*.

Figure 2:
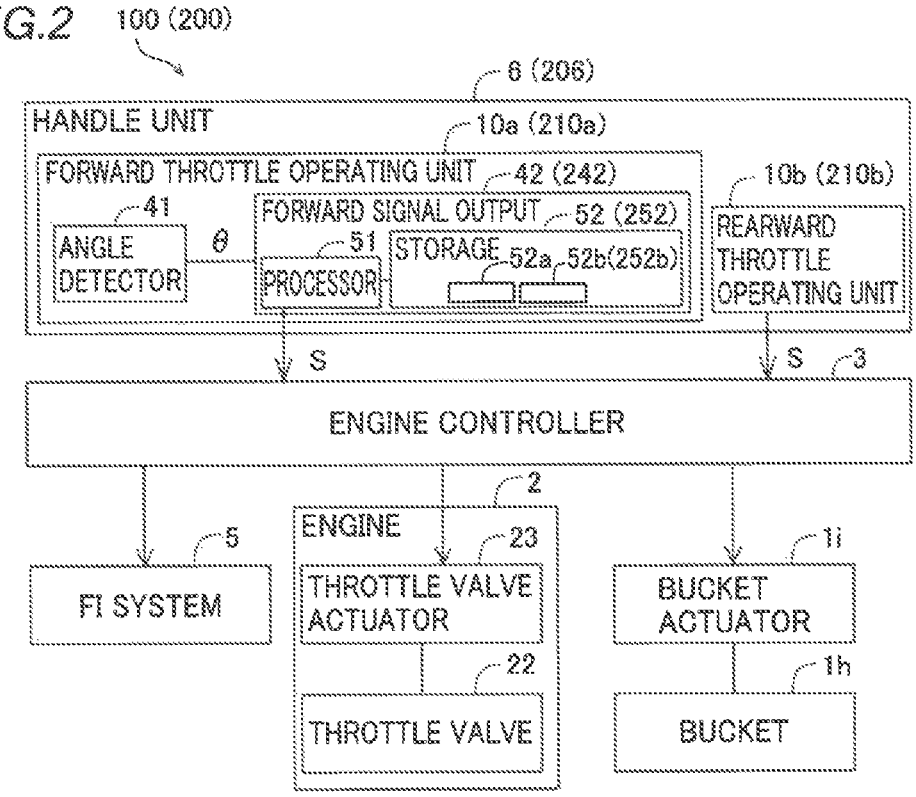
FIG. 2 is a block diagram showing the structure of the small boat according to the first preferred embodiment of the present invention.

As shown in FIG. 2, the engine controller 3 is an ECU (engine control unit), and controls the driving of the engine 2 based on an operation signal (output signal S) from the handle unit 6. Specifically, the engine controller 3 is electrically connected to the forward operating unit 10*a* (forward signal output 42) and a rearward throttle operating unit 10*b* (hereinafter referred to as a "rearward operating unit 10*b*"). The engine controller 3 controls the driving of the bucket actuator 1*i*, the FI system 5, and the throttle valve actuator 23 based on a control program.

The engine controller 3 drives the throttle valve actuator 23 such that the opening degree of the throttle valve 22 increases as the output voltage value V of the acquired output signal S increases. When acquiring a maximum output voltage value VM, the engine controller 3 drives the throttle valve actuator 23 such that the opening degree of the throttle valve 22 is maximum (fully opened, for example).

When the output voltage value V of the output signal S from the forward operating unit 10*a* is larger than the output voltage value V of the output signal S from the rearward operating unit 10*b*, the engine controller 3 controls the bucket actuator 1*i* to move the bucket 1*h* to the upper side of the deflector 1*g* so as to move the small boat 100 forward. When the output voltage value V of the output signal S from the forward operating unit 10*a* is smaller than the output voltage value V of the output signal S from the rearward operating unit 10*b*, the engine controller 3 controls the bucket actuator 1*i* to move the bucket 1*h* to the rear side of the deflector 1*g* so as to move the small boat 100 rearward.

According to the first preferred embodiment, when acquiring the output signal S having the output voltage value V less than an abnormality detection output voltage value Ve described below from the forward operating unit 10*a* or the rearward operating unit 10*b*, the engine controller 3 stops the driving of the engine 2 or sets the engine 2 to idle. Note that the term "idle" indicates a state in which the engine controller 3 controls the throttle valve actuator 23 and the FI system 5 such that the engine 2 reaches a rotational speed within an idling rotational speed range. That is, when acquiring the output signal S having the output voltage value V (0 [V], for example) less than the abnormality detection output voltage value Ve as a lower limit from the forward operating unit 10*a* or the rearward operating unit 10*b*, the engine controller 3 detects the abnormality of the forward operating unit 10*a* or the rearward operating unit 10*b*, or the abnormality of wiring between the forward operating unit 10*a* or the rearward operating unit 10*b* and the engine controller 3.

Figure 3:
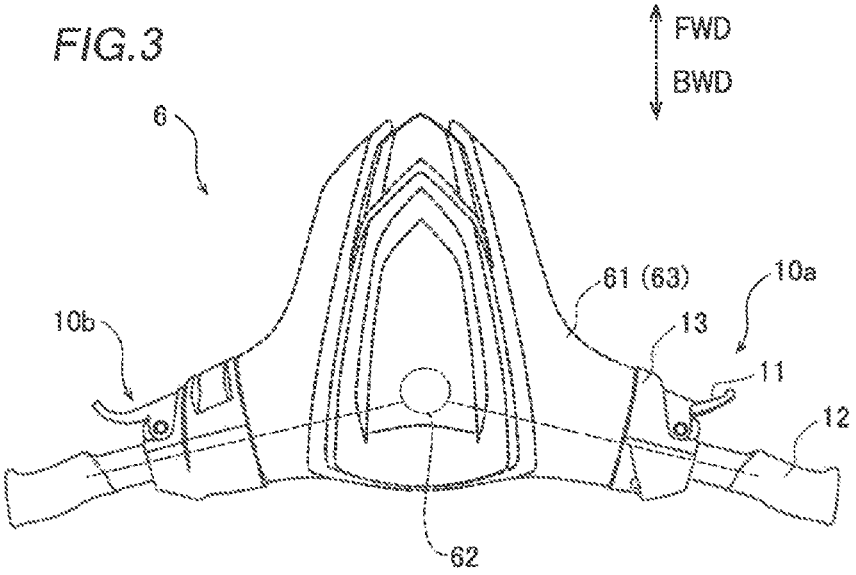
FIG. 3 is a plan view showing the structure of a handle unit according to the first preferred embodiment of the present invention.

As shown in FIG. 3, the handle unit 6 includes the forward operating unit 10*a* grasped by the right hand and the rearward operating unit 10*b* grasped by the left hand, for example, when the rider P steers. Furthermore, the handle unit 6 includes a handle main body 61 to which the forward operating unit 10*a* and the rearward operating unit 10*b* are attached. According to the first preferred embodiment, the forward operating unit 10*a* and the rearward operating unit 10*b* are replaceable (detachable) from the handle main body 61. For example, the forward operating unit 10*a* and the rearward operating unit 10*b* shown by solid lines are detachable from a dotted portion of the handle main body 61 shown in FIG. 3 by removing fasteners (not shown).

The handle main body 61 includes the steering shaft 62 and a case 63 that covers the steering shaft 62. The steering shaft 62 rotates in response to the positions of the forward operating unit 10*a* and the rearward operating unit 10*b*. The steering shaft 62 transmits the rotation to the deflector 1*g* via the steering cable (not shown).

Figure 4:
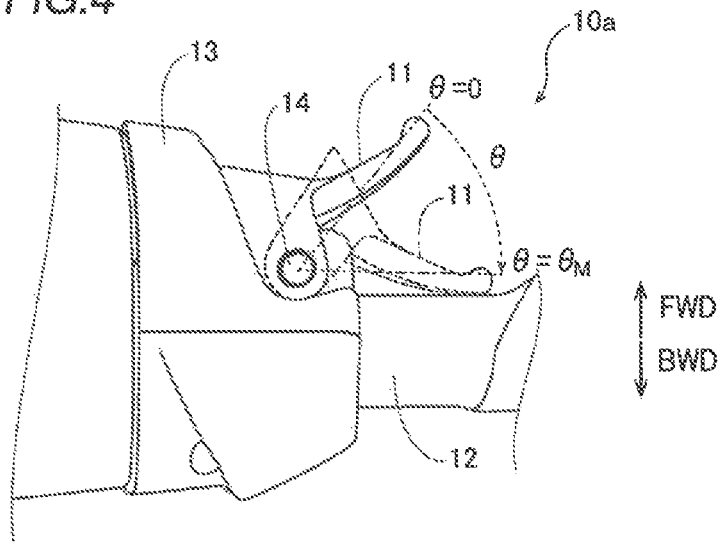
FIG. 4 is a plan view showing the structure of a forward throttle operating unit according to the first preferred embodiment of the present invention.

As shown in FIG. 4, according to the first preferred embodiment, the forward operating unit 10*a* includes a throttle lever 11 (hereinafter referred to as a "lever 11") that controls the opening degree (throttle opening degree) of the throttle valve 22 of the engine 2, a grip 12 grasped by the rider P, and an operating unit housing 13 to which the lever 11 and the grip 12 are attached. The lever 11 is operated by being rotated with respect to the operating unit housing 13. The lever 11 is an example of a "throttle operator".

Figure 5:
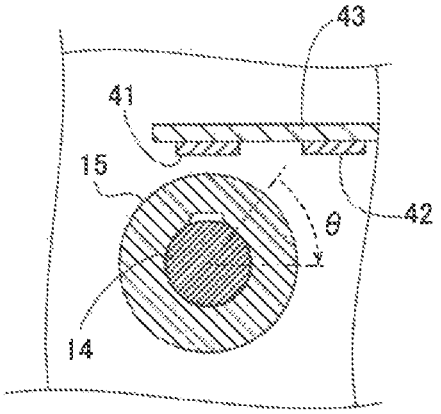
FIG. 5 is a diagram illustrating detection of a rotation angle according to the first preferred embodiment of the present invention.

As shown in FIG. 5, the forward operating unit 10*a* includes an angle detector 41, the forward signal output 42, and a board 43 disposed inside the operating unit housing 13. An accelerator position sensor (APS) includes the angle detector 41 and the forward signal output 42. The angle detector 41 detects the operation amount (the rotation angle θ described below) of the lever 11. The forward signal output 42 outputs the output signal S to the engine controller 3 based on a detection signal (information about the rotation angle θ) from the angle detector 41. The angle detector 41 and the forward signal output 42 are disposed on the board 43, for example. The forward signal output 42 is mounted as an element on the board 43. The forward signal output 42 is an example of an "output".

Figure 6:
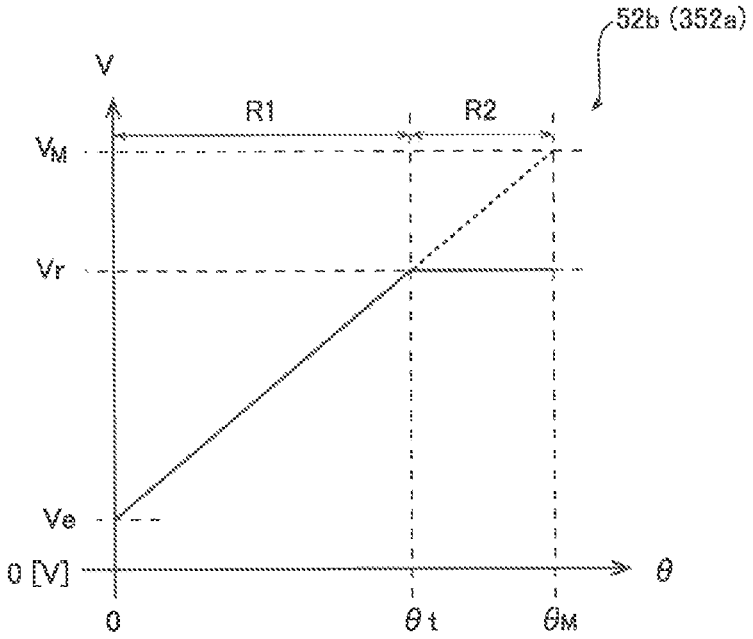
FIG. 6 is a diagram illustrating characteristics information according to the first preferred embodiment of the present invention.

The forward signal output 42 is electrically connected to the engine controller 3 (see FIG. 2). As shown in FIG. 6, according to the first preferred embodiment, the forward signal output 42 outputs the output signal S having the output voltage value V at which the opening degree of the throttle valve 22 increases as the rotation angle θ of the lever 11 increases, and outputs the output signal S having, as an upper limit, the limit output voltage value Vr at which the opening degree of the throttle valve 22 is smaller than that at the maximum output voltage value VM at which the opening degree of the throttle valve 22 is maximum, to the engine controller 3.

On the forward operating unit 10*a*, it is visually distinguishable that the upper limit of the output voltage value V of the output signal S is limited to the limit output voltage value Vr. Specifically, the lever 11 shown in FIG. 4 is distinguishable by color that the upper limit of the output voltage value V of the output signal S is limited to the limit output voltage value Vr. More specifically, the color of the lever 11 according to the first preferred embodiment is different from the color of a lever in which the upper limit of the output voltage value V of the output signal S is set (not limited) to the maximum output voltage value VM. That is, when visually recognizing the color of the lever 11, the rider P determines whether the lever 11 (forward operating unit 10*a*) according to the first preferred embodiment is mounted on the small boat 100 or an unlimited lever (forward operating unit) is mounted on the small boat 100.

As shown in FIG. 4, the forward operating unit 10*a* includes a rotation shaft 14. The rotation shaft 14 defines and functions as the rotation center of the lever 11. According to the first preferred embodiment, the lever 11 extends from the rotation shaft 14 in the radial direction of the rotation shaft 14, and rotates about the rotation shaft 14 from a rotation angle of 0 degrees (θ=0) to a maximum angle θM (θ=θM) toward the grip 12. The maximum angle θM is an example of a "maximum operation amount".

The rotation shaft 14 is fixed to the operating unit housing 13 so as to be rotatable integrally with the lever 11 with respect to the operating unit housing 13. For example, the rotation shaft 14 is fixed to the operating unit housing 13 via a biasing member (not shown). A biasing force is applied to the rotation shaft 14 by the biasing member, and when the rider P does not grasp the lever 11, the rotation shaft 14 moves (returns) the lever 11 to the position at a rotation angle of 0 degrees.

As shown in FIG. 5, the angle detector 41 faces the rotation shaft 14 in the radial direction, and detects the rotation angle θ of the rotation shaft 14 as a rotation angle that defines and functions as the operation amount.

Specifically, the angle detector 41 is an element (magnetic detection element) that detects a magnetic change, for example. The angle detector 41 is mounted on the board 43. The rotation shaft 14 includes a magnet 15. For example, the thickness of the magnet 15 in the radial direction is non-uniform in a circumferential direction such that the magnitude of the magnetism detected by the angle detector 41 varies according to the rotation angle θ of the rotation shaft 14. Thus, the angle detector 41 outputs a detection signal having a voltage value corresponding to the rotation angle θ of the rotation shaft 14 to the forward signal output 42 via a circuit on the board 43.

As shown in FIG. 2, the forward signal output 42 includes a processor 51 including a CPU (central processing unit), for example, and a storage 52 (nonvolatile memory, for example) that stores a control program 52*a* and characteristics information 52*b* described below in advance. The processor 51 performs control processing based on the rotation angle θ acquired from the angle detector 41 and the control program 52*a* and the characteristics information 52*b* stored in the storage 52. The characteristics information 52*b* is an example of "output limitation characteristics information".

As shown in FIG. 6, the characteristics information 52*b* is data in which the output voltage value V including the limit output voltage value Vr as an upper limit and the rotation angle θ are associated with each other. According to the first preferred embodiment, the output signal S having the output voltage value V corresponding to the rotation angle θ is output to the engine controller 3 based on (referring to) the characteristics information 52*b*. Specifically, in the characteristics information 52*b*, the abnormality detection output voltage value Ve (lower limit) is set as the output voltage value V corresponding to a rotation angle of 0 degrees (the operation amount is 0). The abnormality detection output voltage value Ve is a voltage value larger than 0 [V] and smaller than the limit output voltage value Vr, for example. The abnormality detection output voltage value Ve is an example of an "abnormality detection output value".

In the characteristics information 52*b*, the output voltage value V at which the opening degree of the throttle valve 22 increases as the rotation angle θ increases over a range R1 from a rotation angle of 0 degrees to a threshold angle θt, which is the rotation angle θ smaller than the maximum angle θM, is set. That is, when the rotation angle θ is larger than 0 degrees, the forward signal output 42 outputs the output signal S having the output voltage value V larger than the abnormality detection output voltage value Ve. The threshold angle θt is an example of an "operation amount threshold".

Specifically, in the characteristics information 52*b*, the output voltage value V at which the opening degree of the throttle valve 22 increases as the rotation angle θ increases such that the rotation angle θ and the output voltage value V have a linear or substantially linear function relationship (proportional relationship) is set. That is, according to the first preferred embodiment, the forward signal output 42 outputs to the engine controller 3 the output signal S having the output voltage value V at which the opening degree of the throttle valve 22 increases as the rotation angle θ increases such that the rotation angle θ and the output voltage value V have a linear or substantially linear function relationship (proportional relationship).

A dotted portion in FIG. 6 shows data (hereinafter referred to as "non-limitation information") in which the output voltage value V including the maximum output voltage value VM as an upper limit (not limited) and the rotation angle θ are associated with each other. Here, the characteristics of a portion (range R1) of the characteristics information 52*b* in which the rotation angle θ and the output voltage value V have a linear or substantially linear function relationship are substantially the same as the characteristics of the range R1 of the non-limitation information. That is, in the range R1, the forward signal output 42 outputs the same output signal S as when the output voltage value V is not limited.

In the characteristics information 52*b*, the limit output voltage value Vr (constant value) is set in a range R2 in which the rotation angle θ is not less than the threshold angle θt and not more than the maximum angle θM. That is, according to the first preferred embodiment, when the rotation angle θ detected by the angle detector 41 is the maximum angle θM (in the range R2 of not less than the threshold angle θ and not more than the maximum angle θM), the forward signal output 42 outputs the output signal S having the limit output voltage value Vr, when the operation amount of the lever 11 is the maximum operation amount, to the engine controller 3. The structure of the rearward operating unit 10*b* is similar to the structure of the forward operating unit 10*a*, and thus description thereof is omitted.

According to the first preferred embodiment of the present invention, the following advantageous effects are achieved.

According to the first preferred embodiment of the present invention, the forward signal output 42 outputs to the engine controller 3 the output signal S having, as an upper limit, the limit output voltage value Vr at which the opening degree of the throttle valve 22 is smaller than that at the maximum output voltage value VM at which the opening degree of the throttle valve 22 is maximum. Accordingly, the horsepower of the small boat 100 (engine 2) is limited to an amount corresponding to the limit output voltage value Vr without limiting the upper limit of the rotation angle θ of the lever 11 (without mechanically limiting the movable range). Consequently, unlike the case in which the movable range of the lever 11 is mechanically limited, no error is caused due to the structure that limits the movable range, and thus the upper limit of the output signal S is more accurately limited. That is, the horsepower is more accurately limited as compared with the case in which the movable range of the lever 11 is mechanically limited. In addition, even when the maximum horsepower (the amount of horsepower to be a specification value) of the engine 2 mounted on the small boat 100 is larger than the horsepower corresponding to the limit output voltage value Vr (the amount of horsepower limited by laws and regulations, for example), the horsepower of the engine 2 of the small boat 100 is limited to an amount corresponding to the limit output voltage value Vr. Thus, it is not necessary to prepare the engine 2 that sets the horsepower corresponding to the limit output voltage value Vr to the specification value (maximum horsepower) separately from the engine 2 having the maximum horsepower larger than the horsepower corresponding to the limit output voltage value Vr, and thus an increase in the number of engine 2 types in the small boat 100 is significantly reduced or prevented. Consequently, the small boat 100 complies with horsepower regulations while an increase in the number of engine 2 types is significantly reduced or prevented. Furthermore, according to the first preferred embodiment, the forward signal output 42 outputs the output signal S having the limit output voltage value Vr as an upper limit to the engine controller 3 such that the horsepower of the small boat 100 is limited by changing (replacing) the forward operating unit 10*a* without changing the control program of the engine controller 3. Thus, the small boat 100 complies with horsepower regulations while the number of inspection steps of the engine controller 3 that operates the entire small boat 100 is reduced as compared with the case in which the control program of the engine controller 3 (ECU) is changed.

According to the first preferred embodiment of the present invention, the forward signal output 42 outputs the output signal S having the limit output voltage value Vr to the engine controller 3 when the operation amount (rotation angle θ) is the maximum operation amount (maximum angle θM). Accordingly, even when the lever 11 is operated from the rotation angle θ to the maximum angle θM (when the rotation angle θ of the lever 11 is not limited), the output signal S having the limit output voltage value Vr as an upper limit is output, and thus the small boat 100 complies with horsepower regulations without changing the range (movable range) of the operation amount of the lever 11.

According to the first preferred embodiment of the present invention, the forward signal output 42 outputs the output signal S having the limit output voltage value Vr to the engine controller 3 when the operation amount (rotation angle θ) is equal to or larger than the threshold angle θ smaller than the maximum operation amount (maximum angle θM). Accordingly, output of the output signal S that exceeds the limit output voltage value Vr is prevented even when the lever 11 is operated to the rotation angle θ equal to or more than the predetermined threshold angle θ.

According to the first preferred embodiment of the present invention, the lever 11 is rotationally operated. Furthermore, the forward operating unit 10*a* includes the angle detector 41 that detects the rotation angle θ of the lever 11. When the rotation angle θ detected by the angle detector 41 is the maximum angle θM, the forward signal output 42 outputs the output signal S having the limit output voltage value Vr, when the operation amount is the maximum operation amount, to the engine controller 3. Accordingly, the upper limit of the output voltage value V of the output signal S is limited to the limit output voltage value Vr without limiting the rotation angle θ of the lever 11 to an angle smaller than the maximum angle θM (without changing the movable range).

According to the first preferred embodiment of the present invention, the lever 11 extends from the rotation shaft 14 disposed adjacent to the grip 12 grasped by the rider P in the radial direction of the rotation shaft 14, and is rotatable about the rotation shaft 14 toward the grip 12. Furthermore, the angle detector 41 faces the rotation shaft 14 in the radial direction, and detects the rotation angle θ of the rotation shaft 14 as the operation amount. When the rotation angle θ detected by the angle detector 41 is the maximum angle θM, the forward signal output 42 outputs the output signal S having the limit output voltage value Vr, when the operation amount is the maximum operation amount, to the engine controller 3. Accordingly, the rotation angle θ is detected without providing a mechanical wire, and the output signal S corresponding to the rotation angle θ is output to the engine controller 3. Consequently, a mechanical wire is not provided, and thus an increase in the number of components in the small boat 100 is significantly reduced or prevented, and an increase in the load required to rotate the lever 11 is significantly reduced or prevented.

According to the first preferred embodiment of the present invention, the forward signal output 42 outputs the output signal S having the output voltage value V corresponding to the rotation angle θ to the engine controller 3 based on the characteristics information 52*b* in which the output voltage value V (output value) including the limit output voltage value Vr (limit output value) as an upper limit and the rotation angle θ (operation amount) are associated with each other. Accordingly, the forward signal output 42 easily generates the output signal S having the output voltage value V corresponding to the rotation angle θ and including the limit output voltage value Vr as an upper limit, referring to the characteristics information 52*b*, and outputs the output signal S to the engine controller 3.

According to the first preferred embodiment of the present invention, in the characteristics information 52*b*, the rotation angle θ and the output voltage value V as the output value are associated with each other. Furthermore, the forward signal output 42 outputs the output signal S having the limit output voltage value Vr, which is the output voltage value V corresponding to the limit output value, as an upper limit to the engine controller 3. Accordingly, the forward signal output 42 outputs the voltage value corresponding to the rotation angle θ, referring to the characteristics information 52*b*, and thus the forward signal output 42 easily outputs the output signal S having the output voltage value V including the limit output voltage value Vr as an upper limit.

According to the first preferred embodiment of the present invention, the forward operating unit 10*a* includes the lever 11 and the forward signal output 42, and is replaceable from the boat body 1. Accordingly, a forward operating unit to which the output signal S having the maximum output voltage value VM as an upper limit is output from the forward signal output is able to be replaced with the forward operating unit 10*a* to which the output signal S having the limit output voltage value Vr as an upper limit is output from the forward signal output 42 such that a state in which the upper limit of the output voltage value V of the output signal S output from the forward signal output 42 becomes the maximum output voltage value VM is easily changed to a state in which the upper limit of the output voltage value V of the output signal S output from the forward signal output 42 becomes the limit output voltage value Vr using the same type of engine 2.

According to the first preferred embodiment of the present invention, on the forward operating unit 10*a* (preferably the lever 11), it is visually distinguishable that the upper limit of the output voltage value V of the output signal S is limited to the limit output voltage value Vr. Accordingly, even when the same type of engine 2 is used, the rider P recognizes whether or not the upper limit of the output voltage value V of the output signal S output from the forward signal output 42 is limited to the limit output voltage value Vr by visually recognizing the forward operating unit 10*a*.

According to the first preferred embodiment of the present invention, on the forward operating unit 10*a* (preferably the lever 11), it is distinguishable by color that the upper limit of the output voltage value V of the output signal S is limited to the limit output voltage value Vr. Accordingly, the color of the forward operating unit 10*a* in which the upper limit of the output voltage value V of the output signal S output from the forward signal output 42 is limited to the limit output voltage value Vr is different from the color of a forward operating unit in which the upper limit of the output voltage value V is not limited to the limit output voltage value Vr such that the rider P more intuitively recognizes whether or not the upper limit of the output voltage value V of the output signal S is limited to the limit output voltage value Vr.

According to the first preferred embodiment of the present invention, the forward signal output 42 outputs the abnormality detection output voltage value Ve as the output signal S to the engine controller 3 when the rotation angle θ is 0, and outputs the output signal S having the limit output voltage value Vr, which is larger than the abnormality detection output voltage value Ve, as an upper limit to the engine controller 3 when the rotation angle θ is larger than 0. Furthermore, the engine controller 3 stops the engine 2 or sets the engine 2 to idle when acquiring the output signal S having the output voltage value V less than the abnormality detection output voltage value Ve. Accordingly, the small boat 100 includes an abnormality detection function of stopping the engine 2 or setting the engine 2 to idle when acquiring the output signal S having the output voltage value V less than the abnormality detection output voltage value Ve, and the output signal S having the limit output voltage value Vr as an upper limit is output to the engine controller 3.

Second Preferred Embodiment

The structure of a small boat 200 according to a second preferred embodiment of the present invention is now described with reference to FIGS. 1 and 7. In the small boat 200 according to the second preferred embodiment, an output signal S having an output voltage value V at which the opening degree of a throttle valve 22 increases as the rotation angle θ of a lever 11 increases over a range R3 from a rotation angle of 0 degrees to a maximum angle θM is output, unlike the small boat 100 according to the first preferred embodiment in which the constant limit output voltage value Vr is output when the rotation angle θ is equal to or more than the threshold angle θt. In the second preferred embodiment, the same structures as those of the first preferred embodiment are denoted by the same reference numerals, and description thereof is omitted.

As shown in FIG. 2, the small boat 200 according to the second preferred embodiment includes a handle unit 206. The handle unit 206 includes a forward operating unit 210*a* and a rearward operating unit 210*b*. The forward operating unit 210*a* includes a forward signal output 242. The forward signal output 242 includes a storage 252 that stores characteristics information 252*b*.

Figure 7:
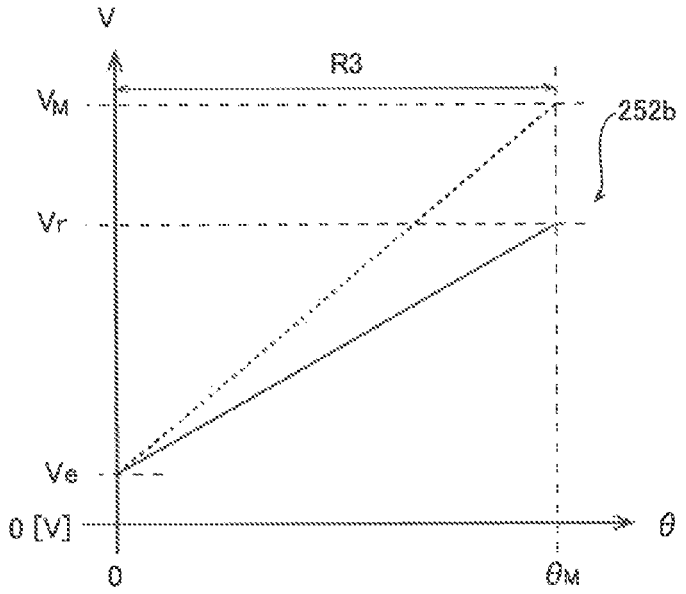
FIG. 7 is a diagram illustrating characteristics information according to a second preferred embodiment of the present invention.

As shown in FIG. 7, according to the second preferred embodiment, in the characteristics information 252*b*, the rotation angle θ and the output voltage value V including a limit output voltage value Vr as an upper limit are associated with each other such that the rotation angle θ and the output voltage value V have a linear or substantially linear function relationship over the range R3 in which the rotation angle θ (operation amount) of the lever 11 (see FIG. 4) is 0 degrees to the maximum angle θM (maximum operation amount). Thus, the forward signal output 242 outputs to an engine controller 3 the output signal S having the output voltage value V (high output voltage value V) at which the opening degree of the throttle valve 22 increases as the rotation angle θ increases over the range R3 in which the rotation angle θ of the lever 11 is 0 degrees to the maximum angle θM. The output voltage value V including the limit output voltage value Vr as an upper limit and the rotation angle θ have a linear or substantially linear function relationship. Thus, the slope of the output voltage value V with respect to the rotation angle θ in the characteristics information 252*b* (solid line) is smaller than the slope of the output voltage value V with respect to the rotation angle θ in the range R3 of non-limitation information (dotted line).

In the characteristics information 252*b*, the output voltage value V corresponding to the maximum angle θM becomes the limit output voltage value Vr. The remaining structures of the second preferred embodiment are similar to those of the first preferred embodiment.

According to the second preferred embodiment of the present invention, the following advantageous effects are achieved.

According to the second preferred embodiment of the present invention, the forward signal output 242 outputs, to the engine controller 3, the output signal S having the output voltage value V at which the throttle opening degree increases as the rotation angle θ increases over the range R3 from a rotation angle θ of 0 degrees to the maximum angle θM. Accordingly, the output voltage value V corresponding to the rotation angle θ is output (the throttle opening degree is adjusted) over the range R3 from the rotation angle θ of 0 degrees to the maximum angle θM while the upper limit of the output voltage value V is limited to the limit output voltage value Vr, and thus while the small boat 200 complies with horsepower regulations, the output voltage value V is more precisely adjusted as compared with the case in which the output signal S having the limit output voltage value Vr (constant value) at the rotation angle θ equal to or more than the threshold angle θ is output.

According to the second preferred embodiment of the present invention, the forward signal output 242 outputs, to the engine controller 3, the output signal S having the output voltage value V at which the throttle opening degree increases as the rotation angle θ increases such that the rotation angle θ and the output voltage value V have a linear or substantially linear function relationship over the range R3 from a rotation angle θ of 0 degrees to the maximum operation amount M. Accordingly, even when the upper limit of the output voltage value V is limited to the limit output voltage value Vr, a rider P more intuitively adjusts the output voltage value V as compared with the case in which the rotation angle θ and the output voltage value V have a relatively complicated relationship (output characteristics) other than the linear function. The remaining advantageous effects of the second preferred embodiment are similar to those of the first preferred embodiment.

Third Preferred Embodiment

The structure of a small boat 300 according to a third preferred embodiment of the present invention is now described with reference to FIGS. 8 and 9. In the small boat 300 according to the third preferred embodiment, a forward signal output 342 includes a first storage 352 that stores limitation characteristics information 352*a* and a second storage 353 that stores non-limitation characteristics information 353*a*. In the third preferred embodiment, the same structures as those of the first and second preferred embodiments are denoted by the same reference numerals, and description thereof is omitted.

Figure 8:
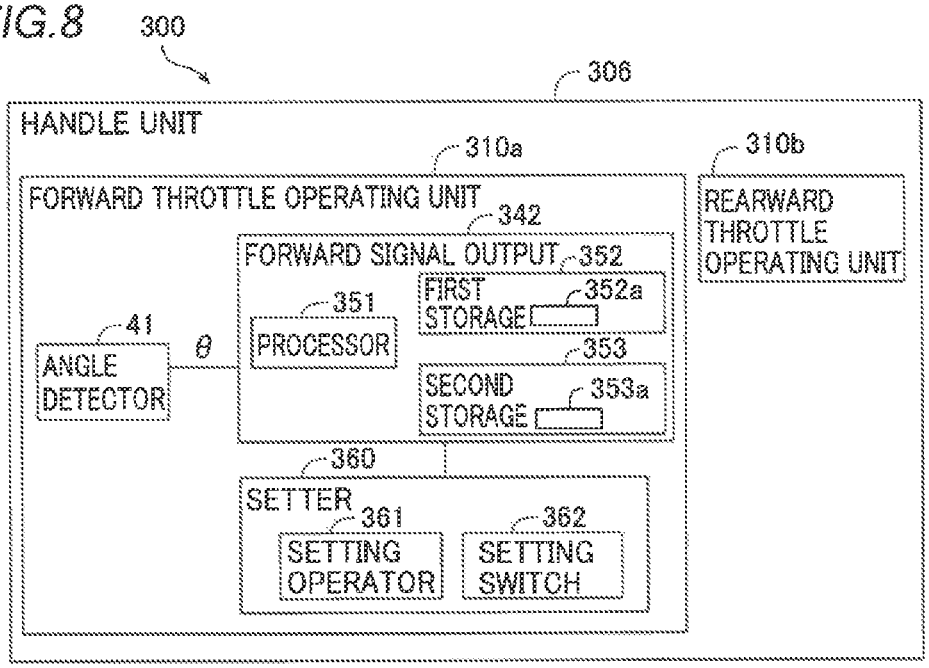
FIG. 8 is a block diagram showing the structure of a small boat according to a third preferred embodiment of the present invention.
Figure 9:
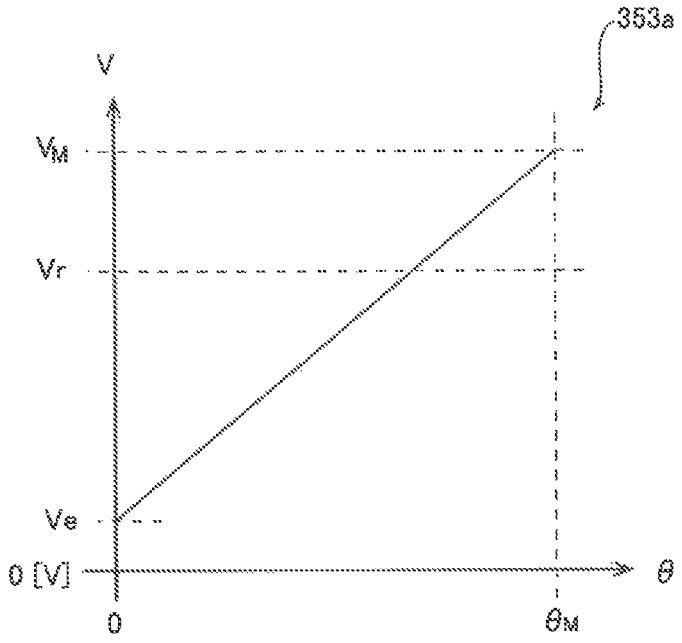
FIG. 9 is a diagram illustrating unlimited characteristics information according to the third preferred embodiment of the present invention.

As shown in FIG. 8, the small boat 300 according to the third preferred embodiment includes a handle unit 306. The handle unit 306 includes a forward operating unit 310*a* and a rearward operating unit 310*b*. The forward operating unit 310*a* includes the forward signal output 342. The forward signal output 342 includes a processor 351, the first storage 352 that stores the limitation characteristics information 352*a*, and the second storage 353 that stores the non-limitation characteristics information 353*a*. The limitation characteristics information 352*a* is similar to the characteristics information 52*b* (see FIG. 6) according to the first preferred embodiment. As shown in FIG. 9, in the non-limitation characteristics information 353*a*, an output voltage value V including a maximum output voltage value VM as an upper limit and a rotation angle θ are associated with each other. The limitation characteristics information 352*a* is an example of "output limitation characteristics information". The non-limitation characteristics information 353*a* is an example of "output non-limitation characteristics information".

As shown in FIG. 8, according to the third preferred embodiment, the forward operating unit 310*a* includes a setter 360 that sets one of the limitation characteristics information 352*a* and the non-limitation characteristics information 353*a*. The setter 360 includes a setting operator 361 and a setting switch 362.

Figure 10:
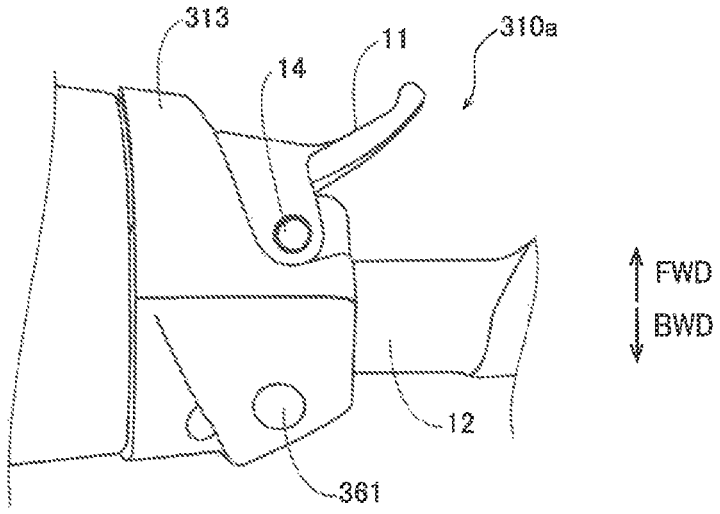
FIG. 10 is a diagram illustrating the placement position of a setting operator according to the third preferred embodiment of the present invention.

As shown in FIG. 10, the setting operator 361 is disposed on an operating unit housing 313 of the forward operating unit 310*a*, and includes a push button, for example. Preferably, one operation method (pressing for a short time, for example) of the existing operator of the forward operating unit 310*a* is changed to another operation method (pressing for a long time, for example) such that the operation is received as an operation on the setting operator 361.

The setting switch 362 switches between a state in which the processor 351 is connected to the first storage 352 and a state in which the processor 351 is connected to the second storage 353 according to an operation on the setting operator 361.

The forward signal output 342 outputs an output signal S based on the limitation characteristics information 352*a* to an engine controller 3 when the processor 351 is connected to the first storage 352, and outputs an output signal S based on the non-limitation characteristics information 353*a* to the engine controller 3 when the processor 351 is connected to the second storage 353.

Thus, when a rider P operates the small boat 300 in an area in which the upper limit of the horsepower corresponding to a limit output voltage value Vr is regulated, or when a rider P not permitted to operate the small boat 300 having a horsepower that exceeds the horsepower corresponding to the limit output voltage value Vr operates the small boat 300, the forward signal output 342 outputs the output signal S based on the limitation characteristics information 352*a* to the engine controller 3 due to setting by the setter 360. When the rider P operates the small boat 300 in an area in which the horsepower is not regulated, for example, the forward signal output 342 outputs the output signal S based on the non-limitation characteristics information 353*a* to the engine controller 3 due to setting by the setter 360. Note that the rearward operating unit 310*b* is structurally similar to the forward operating unit 310*a*. The remaining structures of the third preferred embodiment are similar to those of the first preferred embodiment.

According to the third preferred embodiment of the present invention, the following advantageous effects are achieved.

According to the third preferred embodiment of the present invention, the forward operating unit 310*a* includes the setter 360 that sets one of the limitation characteristics information 352*a* and the non-limitation characteristics information 353*a* in which the output voltage value V including the maximum output voltage value VM as an upper limit and the rotation angle θ are associated with each other. Furthermore, the forward signal output 342 outputs the output signal S having the output voltage value V corresponding to the rotation angle θ to the engine controller 3 based on one of the limitation characteristics information 352*a* and the non-limitation characteristics information 353*a* set by the setter 360. Accordingly, setting of the limitation characteristics information 352*a* and the non-limitation characteristics information 353*a* is switched such that output signals S having different output voltage values V as upper limits are output from the forward signal output 342 using the same type of engine (small boat 300). Consequently, the upper limit of the output voltage value V of the output signal S is changed according to the limited horsepower using the same type of engine 2 (small boat 300), and thus even when the rider P is changed (to a rider with a different license) or even when the small boat 300 is moved to countries having different horsepower regulations, the small boat 300 complies with the horsepower regulations.

According to the third preferred embodiment of the present invention, the setter 360 includes the setting operator 361 that receives an operation of setting one of the limitation characteristics information 352*a* and the non-limitation characteristics information 353*a*. Accordingly, the rider P or a setting worker operates the setting operator 361 to easily set (select) one of the limitation characteristics information 352*a* and the non-limitation characteristics information 353*a*.

According to the third preferred embodiment of the present invention, the forward signal output 342 includes the first storage 352 that stores the limitation characteristics information 352*a* and the second storage 353 that stores the non-limitation characteristics information 353*a*. Accordingly, the limitation characteristics information 352*a* and the non-limitation characteristics information 353*a* are stored in the first storage 352 and the second storage 353 of the forward signal output 342, and thus the output signal S is generated using the limitation characteristics information 352*a* and the non-limitation characteristics information 353*a* stored in the first storage 352 and the second storage 353 without providing the limitation characteristics information 352*a* and the non-limitation characteristics information 353*a* separately from the forward signal output 342 (small boat 300). Thus, the limitation characteristics information 352*a* and the non-limitation characteristics information 353*a* are written in the first storage 352 and the second storage 353 of the forward signal output 342 such that the forward signal output 342 easily outputs the output signal S corresponding to the limitation characteristics information 352*a* or the non-limitation characteristics information 353*a*. The remaining advantageous effects of the third preferred embodiment are similar to those of the first preferred embodiment.

Fourth Preferred Embodiment

The structure of a small boat 400 according to a fourth preferred embodiment of the present invention is now described with reference to FIGS. 11 and 12. In the fourth preferred embodiment, when a lever 11 is at a maximum angle θM, an output signal S is output in a state in which a maximum output voltage value VM of a maximum signal SM output from a maximum signal output 442*a* is reduced to a limit output voltage value Vr. In the fourth preferred embodiment, the same structures as those of the first to third preferred embodiments are denoted by the same reference numerals, and description thereof is omitted.

Figure 11:
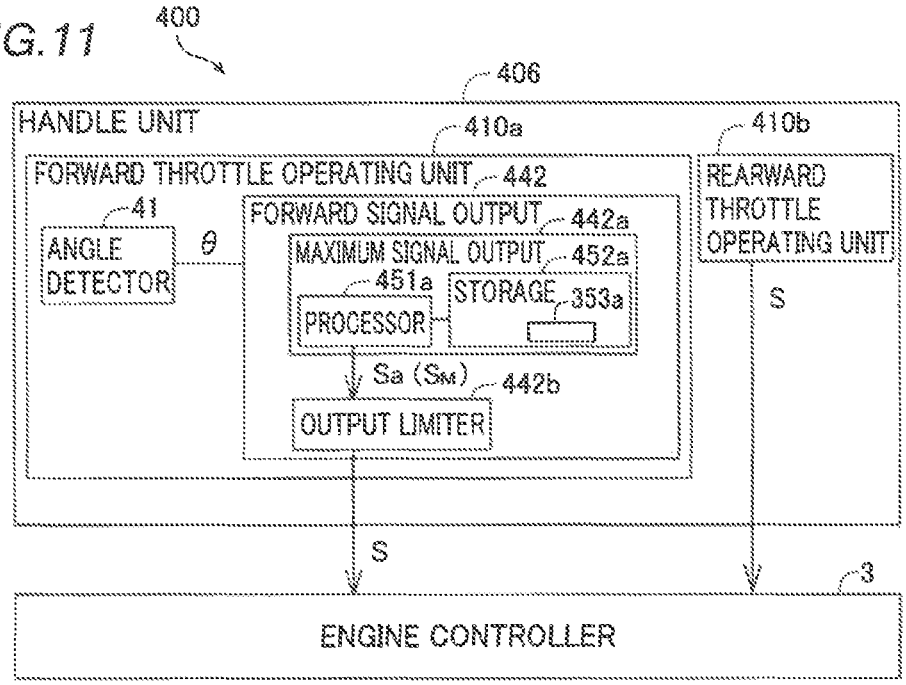
FIG. 11 is a block diagram showing the structure of a small boat according to a fourth preferred embodiment of the present invention.
Figure 12:
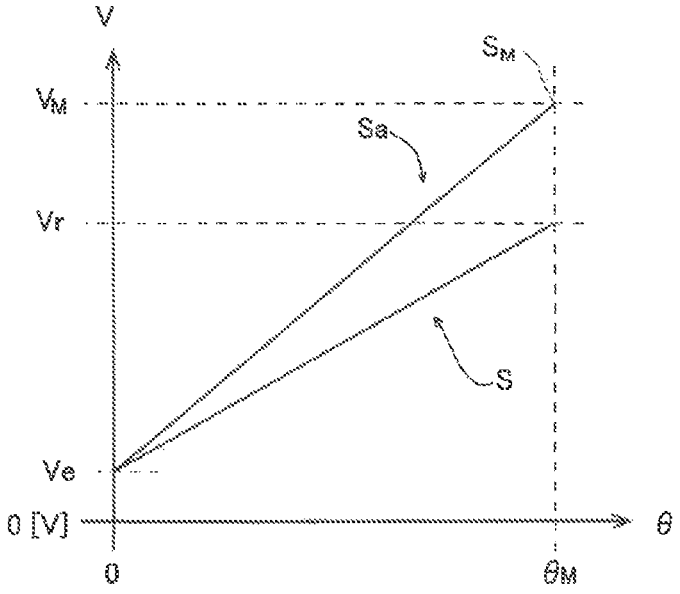
FIG. 12 is a diagram illustrating the structure of a forward signal output according to the fourth preferred embodiment of the present invention.

As shown in FIG. 11, the small boat 400 according to the fourth preferred embodiment includes a handle unit 406. The handle unit 406 includes a forward operating unit 410*a* and a rearward operating unit 410*b*. The forward operating unit 410*a* includes a forward signal output 442. The forward signal output 442 includes the maximum signal output 442*a* that outputs the maximum signal SM, which is a signal having the maximum output voltage value VM, when the rotation angle θ of the lever 11 is the maximum angle θM, and an output limiter 442*b* that outputs the output signal S in a state in which the maximum output voltage value VM of the maximum signal SM output from the maximum signal output 442*a* is reduced to the limit output voltage value Vr.

Specifically, the maximum signal output 442*a* includes a processor 451*a* and a storage 452*a* that stores non-limitation characteristics information 353*a* (similar to the non-limitation characteristics information 353*a* according to the third preferred embodiment). The maximum signal output 442*a* outputs an output signal Sa having the maximum output voltage value VM as an upper limit to the output limiter 442*b*. When the output signal Sa has the maximum output voltage value VM, the same is defined as the maximum signal SM.

The output limiter 442*b* lowers the output voltage value V of the output signal Sa. For example, the output limiter 442*b* includes a resistor. Thus, as shown in FIG. 12, the output limiter 442*b* converts the output signal Sa having the maximum output voltage value VM as an upper limit to the output signal S having the limit output voltage value Vr as an upper limit, and outputs the same to an engine controller 3. Note that the rearward operating unit 410*b* is structurally similar to the forward operating unit 410*a*. The remaining structures of the fourth preferred embodiment are similar to those of the first preferred embodiment.

According to the fourth preferred embodiment of the present invention, the following advantageous effects are achieved.

According to the fourth preferred embodiment of the present invention, the forward signal output 442 includes the maximum signal output 442*a* that outputs the maximum signal SM, which is a signal having the maximum output voltage value VM, when the rotation angle θ is the maximum angle θM, and the output limiter 442*b* that outputs the output signal S in a state in which the maximum output voltage value VM of the maximum signal SM output from the maximum signal output 442*a* is reduced to the limit output voltage value Vr when the rotation angle θ is the maximum angle θM. Accordingly, the output limiter 442*b* is added to the structure of the existing maximum signal output 442*a* such that the forward signal output 442 easily outputs the output signal S having the limit output voltage value Vr as an upper limit. The remaining advantageous effects of the fourth preferred embodiment are similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the small boat is preferably a PWC and a water jet propelled boat in each of the first to fourth preferred embodiments described above, the present invention is not restricted to this. For example, a propulsion device (an inboard motor or an outboard motor) other than a jet may alternatively be provided in the small boat.

While the rotation angle of the lever is preferably used as the operation amount in each of the first to fourth preferred embodiments described above, the present invention is not restricted to this. For example, the parallel movement amount of the operator that moves in parallel may alternatively be used as the operation amount, or the grip may alternatively be rotatable and the rotation angle of the grip may alternatively be used as the operation amount.

While the forward signal output preferably outputs to the engine controller the output signal having the output voltage value that increases as the rotation angle increases such that the rotation angle of the lever and the output voltage value have a linear or substantially linear function relationship in each of the first to fourth preferred embodiments described above, the present invention is not restricted to this. For example, the forward signal output may alternatively output to the engine controller the output signal having the output voltage value that increases as the rotation angle increases such that the rotation angle of the lever and the output voltage value have a quadratic function or logarithmic function relationship.

While the rotation angle of the rotation shaft that integrally rotates with the lever is preferably detected by the angle detector that faces the rotation shaft in the radial direction (no mechanical wire is preferably provided) in each of the first to fourth preferred embodiments described above, the present invention is not restricted to this. For example, a mechanical wire may alternatively be connected to the rotation shaft, and the rotation angle may alternatively be detected by the angle detector spaced apart from the rotation shaft (adjacent to the engine controller, for example).

While the output value is preferably an output voltage value in each of the first to fourth preferred embodiments described above, the present invention is not restricted to this. For example, the output value may alternatively be an output current value.

While the engine controller preferably performs control such that the throttle opening degree increases as the output voltage value increases in each of the first to fourth preferred embodiments described above, the present invention is not restricted to this. For example, the engine controller may alternatively perform control such that the throttle opening degree increases as the output voltage value decreases. In this case, the "upper limit of the output voltage value" indicates the smallest output voltage value at which the throttle opening degree is maximum.

While the forward signal output preferably outputs the output voltage value corresponding to the rotation angle with the processor that refers to the characteristics information stored in the storage in each of the first to fourth preferred embodiments described above, the present invention is not restricted to this. For example, the forward signal output may alternatively include a combination (hardware) of a plurality of electric components disposed on the board.

While the characteristics information is preferably set from one piece of limitation characteristics information and one piece of non-limitation characteristics information in the third preferred embodiment described above, the present invention is not restricted to this. For example, the characteristics information may alternatively be set from a plurality of pieces of limitation characteristics information and one piece of non-limitation characteristics information.

While the output limiter 442*b* preferably includes a resistor that lowers the voltage value, and the output signal S is preferably output in a state in which the maximum output voltage value VM is reduced to the limit output voltage value Vr in the fourth preferred embodiment described above, the present invention is not restricted to this. For example, the output limiter 442*b* may alternatively include an electronic component that defines and functions as a limiter that limits a voltage value exceeding the limit output voltage value Vr to the limit output voltage value Vr, and when the rotation angle θ is equal to or more than the threshold angle θt, the output signal S may alternatively be output in a state in which the maximum output voltage value VM of the maximum signal SM output from the maximum signal output 442*a* is limited to the limit output voltage value Vr.

While the lever is preferably distinguishable by color that the upper limit of the output voltage value of the output signal is limited to the limit output voltage value in the first to fourth preferred embodiments described above, the present invention is not restricted to this. For example, an indicator (sticker) indicating that the upper limit of the output voltage value of the output signal is limited to the limit output voltage value may alternatively be affixed to the operating unit housing or the grip such that it is distinguishable.

While the lower limit of the output voltage value is preferably set as the abnormality detection output voltage value in each of the first to fourth preferred embodiments described above, the present invention is not restricted to this. For example, when abnormality detection is not required, the lower limit of the output voltage value may alternatively be 0 [V].

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat comprising:

a throttle operator through which a throttle opening degree of an engine is controlled;

an engine controller configured or programmed to control the throttle opening degree;

a signal processor provided separately from the engine controller; and a throttle operating device main body in which the throttle operator and the signal processor are disposed and that is replaceable from a boat body; wherein the signal processor is configured or programmed to perform a process to output to the engine controller an output signal having an output value at which the throttle opening degree increases as an operation amount of the throttle operator increases, and to perform a process to output to the engine controller the output signal having, as an upper limit, a limit output value at which the throttle opening degree is smaller than that at a maximum output value at which the throttle opening degree is maximum.

2. The boat according to claim 1, wherein the signal processor is configured or programmed to perform a process to output the output signal having the limit output value to the engine controller when the operation amount is a maximum operation amount.

3. The boat according to claim 2, wherein the signal processor is configured or programmed to perform a process to output the output signal having the limit output value to the engine controller when the operation amount is equal to or larger than an operation amount threshold that is smaller than the maximum operation amount.

4. The boat according to claim 2, wherein the signal processor is configured or programmed to perform a process to output to the engine controller the output signal having the output value at which the throttle opening degree increases as the operation amount increases over a range from the operation amount of 0 to the maximum operation amount.

5. The boat according to claim 4, wherein the signal processor is configured or programmed to perform a process to output to the engine controller the output signal having the output value at which the throttle opening degree increases as the operation amount increases such that the operation amount and the output value have a linear or substantially linear function relationship over a range from the operation amount of 0 to the maximum operation amount.

6. The boat according to claim 2, wherein the signal processor includes a maximum signal output to perform a process to output a maximum signal, which is a signal having the maximum output value, when the operation amount is the maximum operation amount, and an output limiter to perform a process to output the output signal in a state in which the maximum output value of the maximum signal output from the maximum signal output is reduced to the limit output value when the operation amount is the maximum operation amount, or to perform a process to output the output signal in a state in which the maximum output value of the maximum signal output from the maximum signal output is limited to the limit output value when the operation amount is equal to or larger than an operation amount threshold that is smaller than the maximum operation amount.

7. The boat according to claim 2, wherein the throttle operator is rotationally operated;

the boat further comprises an angle detector that detects a rotation angle of the throttle operator; and the signal processor is configured or programmed to perform a process to output the output signal having the limit output value, when the operation amount is the maximum operation amount, to the engine controller when the rotation angle detected by the angle detector is a maximum angle.

8. The boat according to claim 7, wherein the throttle operator extends from a rotation shaft disposed adjacent to a grip grasped by a boat operator in a radial direction of the rotation shaft, and includes a lever that rotates about the rotation shaft toward the grip;

the angle detector faces the rotation shaft in the radial direction, and detects a rotation angle of the rotation shaft as the operation amount; and the signal processor is configured or programmed to perform a process to output the output signal having the limit output value, when the operation amount is the maximum operation amount, to the engine controller when the rotation angle detected by the angle detector is the maximum angle.

9. The boat according to claim 1, wherein the signal processor is configured or programmed to perform a process to output the output signal having the output value corresponding to the operation amount to the engine controller based on output limitation characteristics information in which the output value including the limit output value as an upper limit and the operation amount are associated with each other.

10. The boat according to claim 9, wherein the operation amount and an output voltage value as the output value are associated with each other in the output limitation characteristics information; and the signal processor is configured or programmed to perform a process to output the output signal having a limit output voltage value, which is the output voltage value corresponding to the limit output value, as an upper limit to the engine controller.

11. The boat according to claim 9, further comprising:

a setter that sets one of the output limitation characteristics information and output non-limitation characteristics information in which the output value including the maximum output value as an upper limit and the operation amount are associated with each other; wherein the signal processor is configured or programmed to perform a process to output the output signal having the output value corresponding to the operation amount to the engine controller based on one of the output limitation characteristics information and the output non-limitation characteristics information set by the setter.

12. The boat according to claim 11, wherein the setter includes a setting operator that receives an operation of setting one of the output limitation characteristics information and the output non-limitation characteristics information.

13. The boat according to claim 11, wherein the signal processor includes a storage that stores the output limitation characteristics information and the output non-limitation characteristics information.

14. The boat according to claim 1, wherein the throttle operating device main body is visually distinguishable to enable determination that an upper limit of the output value of the output signal is limited to the limit output value.

15. The boat according to claim 14, wherein the throttle operating device main body is distinguishable by color to enable determination that the upper limit of the output value of the output signal is limited to the limit output value.

16. The boat according to claim 1, wherein the signal processor is configured or programmed to perform a process to output an abnormality detection output value as the output signal to the engine controller when the operation amount is 0, and to perform a process to output the output signal having the limit output value, which is larger than the abnormality detection output value, as an upper limit to the engine controller when the operation amount is larger than 0; and the engine controller stops driving of the engine or sets the engine to idle when acquiring the output signal having the output value less than the abnormality detection output value.

17. A throttle operating device comprising:

a throttle operator through which a throttle opening degree of an engine is controlled;

a signal processor provided separately from an engine controller; and a throttle operating device main body in which the throttle operator and the signal processor are disposed; wherein the signal processor is configured or programmed to perform a process to output to the engine controller that controls the throttle opening degree an output signal having an output value at which the throttle opening degree increases as an operation amount of the throttle operator increases, and to perform a process to output to the engine controller the output signal having, as an upper limit, a limit output value at which the throttle opening degree is smaller than that at a maximum output value at which the throttle opening degree is maximum.

18. The throttle operating device according to claim 17, wherein the signal processor is configured or programmed to perform a process to output the output signal having the limit output value to the engine controller when the operation amount is a maximum operation amount.

19. The throttle operating device according to claim 18, wherein the signal processor is configured or programmed to perform a process to output the output signal having the limit output value to the engine controller when the operation amount is equal to or larger than an operation amount threshold that is smaller than the maximum operation amount.

* * * * *